US008840212B2

(12) United States Patent
Palarya et al.

(10) Patent No.: US 8,840,212 B2
(45) Date of Patent: Sep. 23, 2014

(54) METHOD AND APPARATUS FOR LOADING A PRINTING SUBSTRATE

(75) Inventors: Arkady Palarya, Netunya (IL); Liran Orevi, Rishon LeZion (IL)

(73) Assignee: Hewlett-Packard Industrial Printing Ltd., Netanya (IL)

( * ) Notice: Subject to any disclaimer, the term of this patent is extended or adjusted under 35 U.S.C. 154(b) by 190 days.

(21) Appl. No.: 13/302,357

(22) Filed: Nov. 22, 2011

(65) Prior Publication Data

US 2013/0127967 A1 May 23, 2013

(51) Int. Cl.
*B41J 29/38* (2006.01)
*B41J 11/00* (2006.01)

(52) U.S. Cl.
CPC ..... *B41J 11/0085* (2013.01)
USPC ..... 347/16; 347/104; 347/101

(58) Field of Classification Search
USPC ..... 347/6, 15, 19, 30, 101, 102, 104
See application file for complete search history.

(56) References Cited

U.S. PATENT DOCUMENTS

| | | | | |
|---|---|---|---|---|
| 6,048,120 | A | 4/2000 | Kerr | |
| 6,454,478 | B2 | 9/2002 | Wotton et al. | |
| 7,811,016 | B2 | 10/2010 | Holzer et al. | |
| 2002/0163568 | A1 * | 11/2002 | Takeishi | 347/101 |
| 2010/0220165 | A1 * | 9/2010 | Maekawa et al. | 347/104 |

FOREIGN PATENT DOCUMENTS

| | | | |
|---|---|---|---|
| CN | 201287978 | Y | 8/2009 |
| JP | 2003246042 | A | 9/2003 |
| WO | WO-2010037580 | A2 | 4/2010 |

* cited by examiner

*Primary Examiner* — Juanita D Jackson
*Assistant Examiner* — Alexander C Witkowski

(57) ABSTRACT

According to one example of the present invention there is provided a printing system for printing on a substrate supported on a substrate support. The printing system comprises a plurality of substrate support sections each having an array of orifices selectively in fluid communication with a vacuum source. A controller is configured to apply vacuum pressure from the vacuum source to different ones of the substrate support sections in accordance with a vacuum activation program.

14 Claims, 3 Drawing Sheets

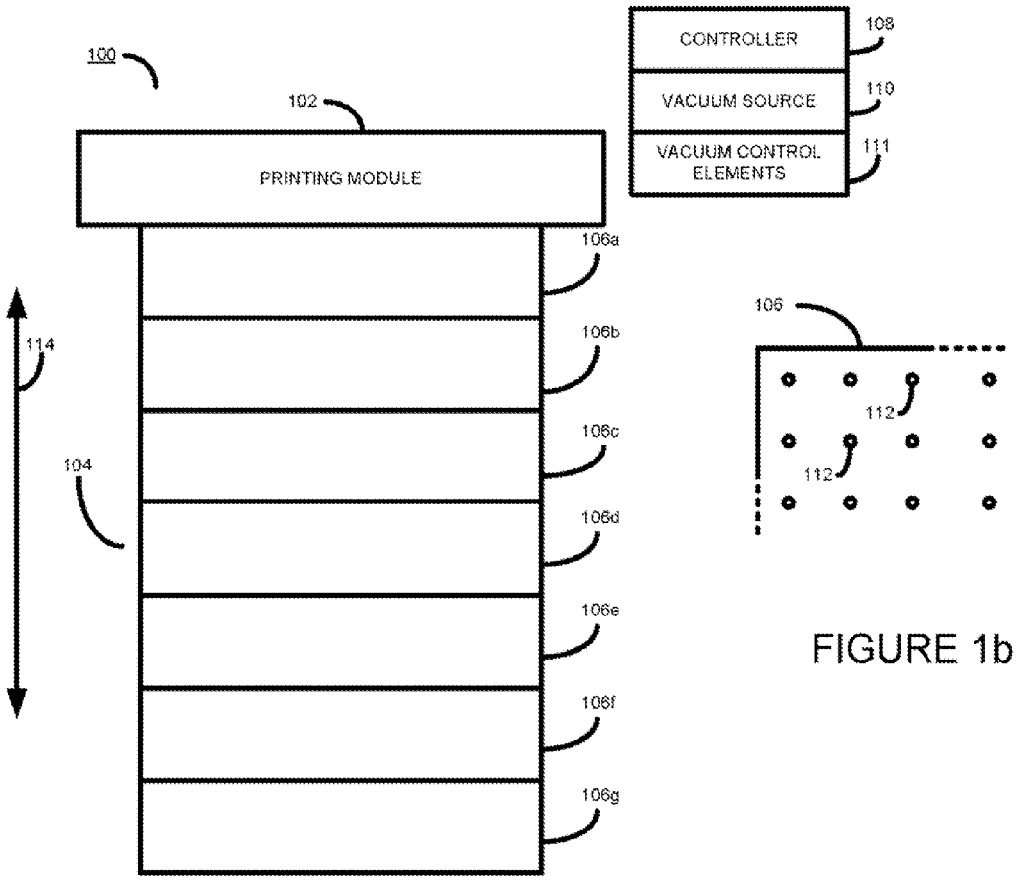
FIGURE 1b
FIGURE 1a
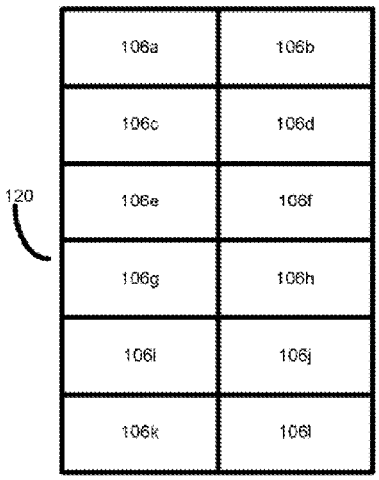
FIGURE 1c
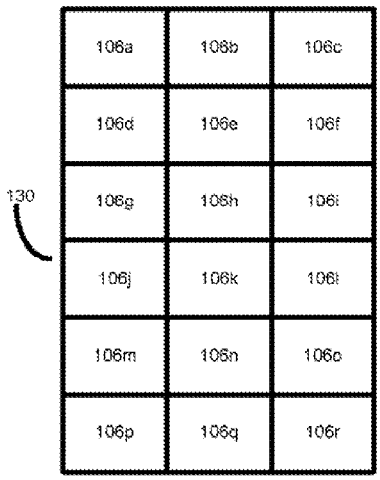
FIGURE 1d

METHOD AND APPARATUS FOR LOADING A PRINTING SUBSTRATE

BACKGROUND

Ink jet printing systems create printed images by ejecting drops of ink from one or multiple printheads onto a media. Typically the printheads are positioned above the media leaving a small gap. The size of the gap may vary between different printing systems, but is typically in the range of one or several millimeters.

Due to the size of the gap it is important that media being printed on be as flat as possible. Variations in the height of the gap, for example caused by wrinkles, bubbles, etc., in the media may lead to print quality issues. If the printheads contact the media damage to the media, the printhead, or both, may occur.

In large format printers, such as so-called industrial printers, media may be in the form of large sheets of flexible or semi-rigid substrates, such as cardboard and vinyl. In such printers substrate sheets are often supported on a substrate support bed or table that uses a vacuum to hold the substrate securely against the substrate support bed. Use of vacuum systems is useful in preventing a substrate from moving during a printing operation, especially in printers where the substrate support bed is moved relative to the printer's printheads. Vacuum systems also help hold substrates flat against the substrate support bed.

However, despite the use of vacuum systems it is common, especially when using certain types of substrate, that air bubbles exist between the substrate and the substrate support bed. Such air bubbles prevent the media from lying flat against the substrate support bed, leading to height variations between the media and the printhead. Accordingly, print quality issues, or even damage to printer components, may occur.

BRIEF DESCRIPTION OF THE DRAWINGS

Examples, or embodiments, of the present invention will now be described, by way of non-limiting example only, with reference to the accompanying drawings, in which:

FIG. 1*a* is a simplified plan view of a printing system according to an example;

FIG. 1*b* is an illustration of an array of vacuum orifices;

FIG. 1*c* is an illustration of an arrangement of a substrate support according to an example;

FIG. 1*d* is an illustration of an arrangement of a substrate support according to an example;

DETAILED DESCRIPTION

Figure 2A:
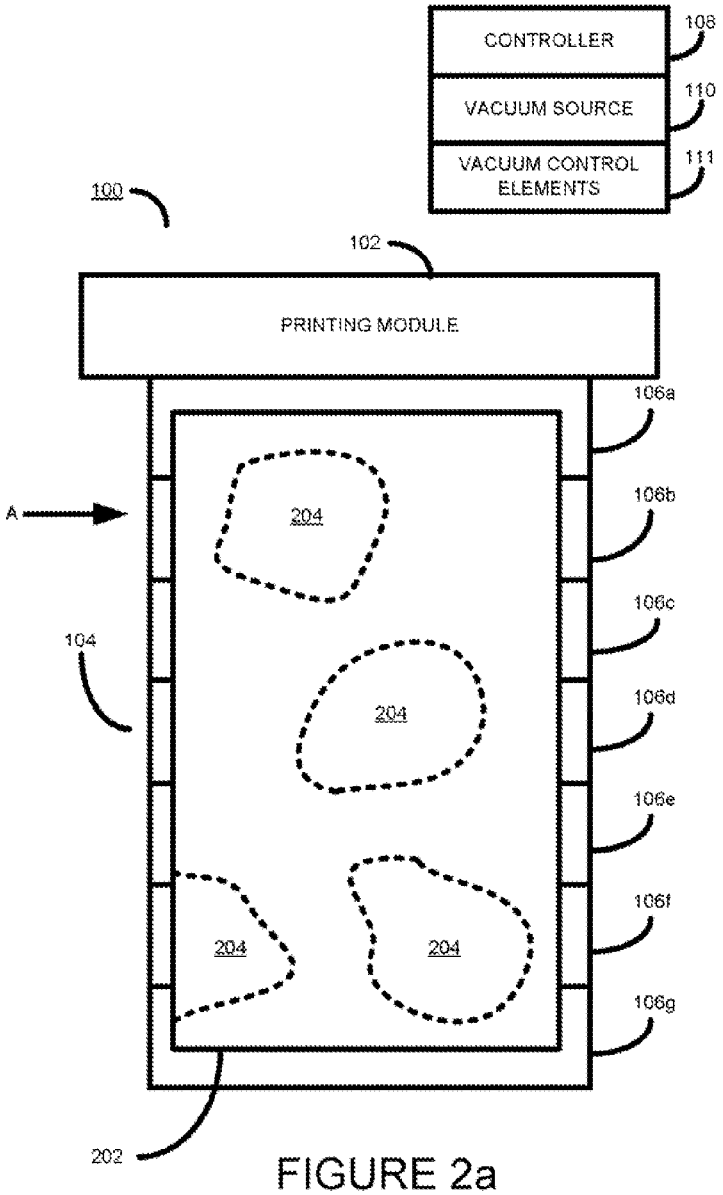
FIG. 2*a* is a simplified plan view of a printing system according to an example.

Referring now to FIG. 1 there is shown a simplified plan view of a printing system 100 according an example of the present invention.

The printing system 100 comprises a printing module 102 configured to eject ink drops from one or multiple printheads (not shown) onto a substrate (not shown) when loaded onto a substrate support 104.

In one example the printing module 102 is configured to remain stationary (although printheads within the printing module 102 may or may not remain stationary) whilst the substrate support 104 moves in the direction of a printing axis 114. In a further example the substrate support 104 is configured to remain stationary whilst the printing module 102 moves in the direction of the printing axis 114, for example on a movable carriage. In both examples, the printing system 100 operates to incrementally form a printed image on a substrate loaded onto the substrate support 104 in a generally known manner.

The substrate support 104 comprises a plurality of sections 106*a* to 106*g*. In one example, each section 106*a* to 106*g*, as illustrated in FIG. 1*b*, comprises an array of orifices 112. The orifices 112 of each section 106 are selectively connectable in fluid communication, using vacuum control elements 111, to a vacuum source 110. For clarity the connections between the vacuum source 110, the vacuum control elements 111, and the substrate support sections 106 are not shown. In one example the vacuum control elements may be electromechanical valves, although in other examples alternative vacuum control elements such as pneumatic or motorized valves may be used. In one example the vacuum source 110 is a vacuum pump. When a substrate support section 106*a* to 106*g* is selected, for example by activating an appropriate vacuum control element 111, and the vacuum source activated, air is sucked in through each of the orifices 112 in the section, thereby providing a vacuum hold-down force to secure a substrate located on the substrate support section.

The selection of which of the substrate bed sections 106*a* to 106*g* are selected to be in fluid communication with the vacuum source 110, along with control of the vacuum source, is controlled by a controller 108. The controller 108 may, in one example, be a general printing system controller that controls general operation of the printing system 100. In a further example the controller 108 is a dedicated controller for controlling operation of the substrate bed 104.

In other examples a substrate support may comprise different numbers of substrate support sections. In some examples the substrate support sections may be of the same or of different shapes, and may be arranged in different manners. Two non-limiting examples are shown in FIG. 1*c* and FIG. 1*d*.

Operation of the printing system 100, according to one example, will now be described with further reference to FIG. 2.

FIG. 2*a* shows a simplified plan view of the printing system 100 of FIG. 1 on which a substrate 202 is loaded. The loading of the substrate 202 may, in one example, be performed using a substrate loading module (not shown). The substrate 202 may, for example, be a semi-rigid or flexible substrate. Once the substrate 202 has been loaded on the substrate support 104 the substrate 202 has to be firmly held against the substrate support 104 prior to a printing operation being performed. This helps ensure that the substrate is held substantially flat against the substrate support 104 and also, in the case where the substrate support is moved under the printing module 102, helps ensure that the substrate does not move during a printing operation.

Due to the physical characteristics of the substrate 202 one or multiple air bubbles or air pockets 204 may become trapped between the substrate support 104 and the substrate 202. These air bubbles may, for example, become trapped as the substrate 202 is loaded onto the substrate support 202, and may occur for a number of reasons. For example, the substrate may be buckled or wrinkled prior to loading which prevents the substrate lying flat against the substrate support 104. In some cases friction between the substrate support and 104 and the substrate 202 may prevent or may inhibit the substrate from lying flat against the substrate support 104. This may be particularly problematic when using substrates composed of, or comprising, materials such as vinyl, paper, textile, linen, polyester, cotton, silk, polyethylene terephthalate (PET), low-density polyethylene (LDPE), high-density polyethylene (HDPE), and polyvinyl chloride (PVC).

Figure 2B:
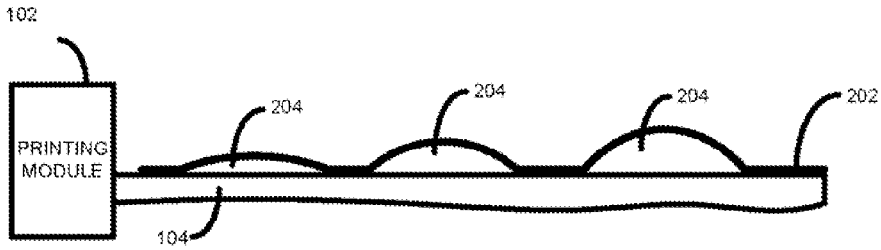
FIG. 2*b* is a simplified side view of a printing system according to an example.

FIG. 2*b* shows a side view of the printing system 100 of FIG. 2*a* in the direction A (shown in FIG. 2*a*) in which the vertical profile of the substrate 202 is shown. In FIG. 2*b* it can be seen that the presence of air bubbles 204 between the substrate support 104 and the substrate 202 causes variations in the height of the substrate 202. Consequently, during a printing operating the height of the gap between a printhead in the printing module 102 and the surface of the substrate 104 will vary and may cause at least some of the previously described quality issues.

Conventionally, vacuum-based substrate supports have generally been configured to uniformly and simultaneously apply vacuum pressure to orifices of all substrate support sections that are at least partially covered by a substrate. This enables a printing system operator to not select a substrate support section if that section is not covered by a substrate, thereby enabling printing to be performed on substrates which are smaller than the substrate support. However, it has been realized that, at least for some types of substrate, uniformly and simultaneously applying vacuum pressure to all of the substrate support sections which are at least partially covered by a substrate does not always lead to the elimination, or even a substantial reduction, of air bubbles trapped between the substrate support and a substrate. Furthermore, applying vacuum pressure in this manner may, in some cases, cause a substrate to move from the position in which it was loaded, which may lead to print alignment problems.

Accordingly, examples described herein enable such air bubbles to be substantially eliminated by applying vacuum pressure to substrate support sections in accordance with a vacuum activation program. Advantageously, this enhances the flatness of a substrate against a substrate support, thereby leading to reduced image quality issues. Furthermore, use of a vacuum activation program may help reduce, or even eliminate, substrate displacement as vacuum pressure is applied to the substrate support.

Figure 3:
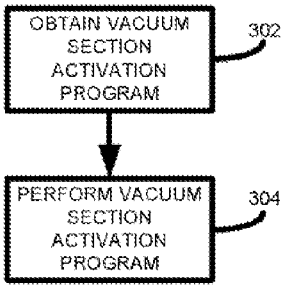
FIG. 3 is a flow diagram outlining an example method of operating a printing system according to an example.

Operation of the printing system 100 according to one example will now be described with additional reference to FIG. 3.

At 302 the controller 108 obtains a vacuum activation program. In one example a vacuum activation program is stored in a memory or storage device accessible to the controller 108. The vacuum activation program may be stored is any suitable format, such as an XML file, a text file, or any suitable format that enables a sequence or set of instructions to be described.

The vacuum activation program defines, for example which of the substrate support sections 106 should have vacuum pressure applied thereto, and also the order in which vacuum pressure should be applied to different ones of the substrate support sections 106. In one example, the vacuum activation program additionally defines timing data that defines, for example, a time delay between activation of different ones of the substrate support sections 106. In a further example, the vacuum activation program additionally defines a vacuum pressure that it is to be applied to different ones of the substrate support sections 106.

Once the vacuum activation program has been obtained the controller 108 controls 304 the vacuum source 110 and vacuum control elements 111 in accordance with the vacuum activation program, thereby causing the obtained vacuum activation program to be performed.

Figure 4:
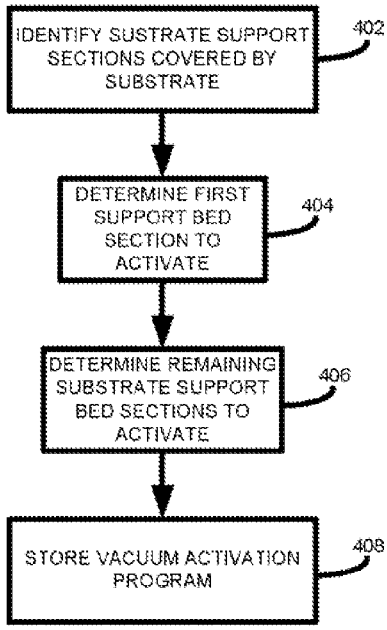
FIG. 4 is a flow diagram outlining an example method of operating a printing system according to an example.

In one example, the vacuum activation program is a predetermined or pre-stored vacuum activation program. In a further example, however, the controller 108 determines or generates a vacuum activation program, as described below with additional reference to the flow diagram of FIG. 4.

At 402 the controller 108 identifies which of the substrate support sections 106 are covered, or are at least partially covered, by a substrate 202 when loaded on the substrate support 104. In one example, the determination is made by a printing system operator identifying the substrate support sections 106 covered or substantially covered by a substrate through a user interface (not shown) of the printing system 100. In a further example, the determination is made automatically by the printing system, for example using mechanical or optical sensors, a camera, a scanner, or the like.

At 404 the controller 108 determines a first subset of the substrate support sections 106 to which vacuum pressure it to be applied in a vacuum activation program.

In one example, the first subset of substrate support sections to which vacuum pressure is to be applied is chosen to be approximately in the center of the substrate loaded on the substrate support 104. However, it should be noted that depending on the size of the substrate on the substrate bed, as well as the size and location of the individual substrate support sections 106, it may not be possible to select a substrate support section that corresponds precisely to the central portion of the substrate.

In one example a vacuum activation program may define multiple substrate support sections 106 as being the first subset of substrate support sections to which vacuum pressure is to be applied.

At 406 the controller 108 determines a further subset of the substrate support sections 106 to which vacuum pressure is to be applied in the vacuum activation program, and further determines the order thereof. In one example, multiple subsets of substrate support sections may be defined by the vacuum activation program.

In one example the controller 108 determines a further subset of substrate support sections 106 to which vacuum pressure is to be applied by next choosing substrate sections immediately adjacent to the first determined subset of sections. Further subsets of sections may be defined in a similar manner until all identified sections of the substrate support have been selected.

One advantage of determining a vacuum activation program in this manner is that the unrestrained edges of the substrate are free to slide along the substrate support 104 as vacuum force is applied to each substrate support section, thereby helping air bubbles trapped between the substrate support and the substrate to be reduced or eliminated.

For example, in the printing system 100 shown in FIG. 2*a*, the controller 108 may determine that the first substrate support section to which vacuum pressure is to be applied in the vacuum activation program will be section 106*d*, followed by sections 106*c* and 106*e* together, followed by sections 106*b* and 106*f* together, followed by sections 106*a* and 106*g*. It should be noted that in the present example vacuum pressure is ultimately applied, and is maintained, across all of the selected substrate support sections 106, until the end of a printing operation.

By way of further example, if the printing system 100 has a substrate support 104 configured as shown in FIG. 1C, the controller 108 may determine that the first substrate support sections to which vacuum pressure is to be applied in the vacuum activation program will be section 106*e* and 106*f* together, followed by sections 106*c*, 106*d*, 106*g*, and 106*h* together, followed by sections 106*a*, 106*b*, 106*i*, and 106*j* together, followed by sections 106*k* and 106*l* together.

By way of further example, if the printing system 100 has a substrate support 104 configured as shown in FIG. 1D, the controller 108 may determine that the first substrate support sections to which vacuum pressure is to be applied in the vacuum activation program will be section 106*h* and 106*k* together, followed by sections 106*e*, 106*g*, 106*i*, 106*j*, 106*l* and 106*n* together, followed by sections 106*b*, 106*d*, 106*f*, 106*m*, 106*o*, and 106*q* together, followed by sections 106*a*, 106*c*, 106*p* and 106*r* together.

At 408 the controller 108 stores the determined vacuum activation program in a suitable memory or storage device accessible to the controller 108.

The controller 108 may subsequently obtain (block 302, FIG. 3) the stored vacuum activation program and perform (block 304, FIG. 3) the vacuum activation program.

Figure 5:
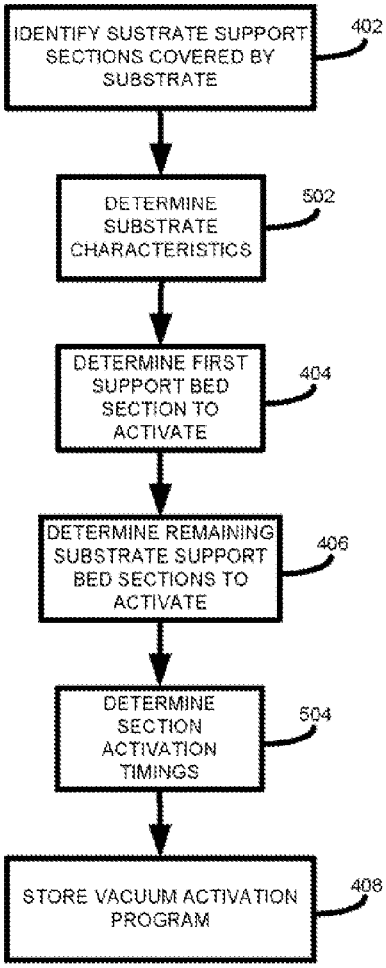
FIG. 5 is a flow diagram outlining an example method of operating a printing system according to an example.

In a further example, the controller 108 performs a number of additional operations, as shown in the flow diagram of FIG. 5. At 502 the controller 108 determines characteristics of the substrate loaded on the substrate support 104. In one example, characteristics may be input to the controller by a printing system operator through a suitable user interface (not shown). In another example, characteristics may be obtained automatically by the printing system 100. For example, the printing system may read a barcode or other identifier on a substrate to determine substrate characteristics. In other examples, the printing system may include sensors that are able to determine substrate characteristics. Characteristics may include, for example, the size of the substrate, the weight of the substrate, the composition of the substrate, the surface friction of the substrate, the stiffness of the substrate, and the thickness of the substrate.

The controller 108 may use the determined characteristics in determining the vacuum activation program. For example, for thin substrates having a low surface friction the controller may determine to apply vacuum pressure to a greater number of substrate support sections simultaneously compared to a thin substrate having a high surface friction. In another example, the controller 108 may determine a vacuum activation program that applies vacuum pressure to a single substrate support section at a time.

At 504 the controller 108 determines timing data that defines, for example, how long vacuum pressure is to be applied to a first selection of substrate support sections before vacuum pressure is applied to a second selection of substrate support sections. In one example, the delay between applying vacuum pressure to different substrate support sections is between 0.5 and 2 seconds. In other examples, however, a shorter or longer time delay may be used, for example based on the power of the vacuum source and/or characteristics of the substrate.

In another example, the controller 108 determines or obtains a vacuum activation program that applies a first vacuum pressure to a first selection of substrate support sections, and applies a second vacuum pressure to a second selection of substrate support sections. In one example a vacuum activation program may define that no vacuum pressure be applied to a substrate support section.

In a further example the controller 108 determines or obtains a vacuum activation program that progressively applies vacuum pressure to all substrate support sections at least partially covered by a substrate, then releases the vacuum pressure either in a progressive or simultaneous manner, and then re-applies vacuum pressure in either the same or a different manner to the initial vacuum activation program.

Figure 6:
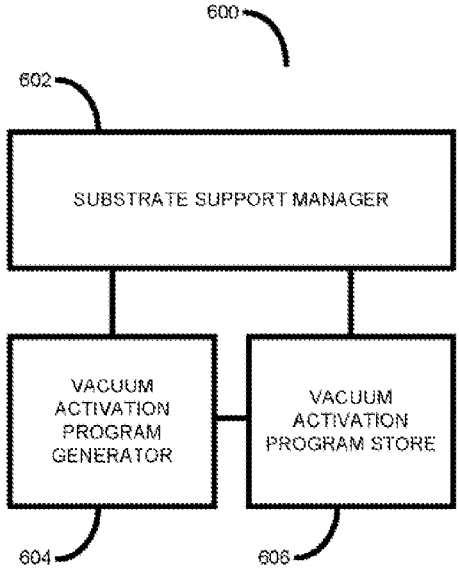
FIG. 6 is a simplified block diagram illustrating an implementation of a substrate support control system according to an example.

Referring now to FIG. 6 there is shown a simplified block diagram of an implementation of a substrate support control system 600 according to one example.

The substrate support control system 600 comprises a substrate support manager module 602, a vacuum activation program generator 604, and a vacuum activation program store 606. The substrate support manager operates, in one example, in accordance with the method described above with reference to FIG. 3. The vacuum activation program generator 604 operates, in one example, in accordance with the method described above with reference to FIG. 4 or 5. The vacuum activation program store may be any suitable memory, disk drive, flash drive, or remote storage device.

Operating a substrate support in accordance with a suitable vacuum activation program may lead to a substantial reduction, or even elimination, of air bubbles trapped between a substrate and a substrate support, thereby reducing, or even eliminating, height variations of a substrate secured on a substrate support. Furthermore, this may be achieved in an automatic, or substantially automatic, manner.

It will be appreciated that some examples of the present invention can be realized in the form of hardware, software or a combination of hardware and software. As described above, any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are examples of machine-readable storage that are suitable for storing a program or programs that, when executed, implement examples of the present invention. Examples of the present invention may be conveyed electronically via any medium such as a communication signal carried over a wired or wireless connection and examples suitably encompass the same.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A printing system for printing on a substrate supported on a substrate support, comprising:

a plurality of substrate support sections each having an array of orifices selectively in fluid communication with a vacuum source;

a store for a vacuum activation program that defines a plurality of the substrate support sections to which vacuum pressure is to be applied; a sequence in which vacuum pressure is to be applied to the plurality of substrate support sections; and timing data that defines a time delay between activation of vacuum pressure to different ones of the substrate support sections; and a controller configured to apply vacuum pressure from the vacuum source to different ones of the substrate support sections in accordance with the vacuum activation program.

2. The printing system of claim 1, further comprising a vacuum activation element through which each substrate support section is selectively connectable in fluid communication with the vacuum source.

3. The printing system of claim 1 further comprising a vacuum activation program generator configured to:

identify which of the substrate support sections are at least partially covered by a substrate loaded on the substrate support;

determine a first subset of the substrate support sections to which vacuum pressure is to be applied; and determine a second subset of the substrate support sections to which vacuum pressure is to be subsequently applied.

4. The printing system of claim 3, wherein the vacuum activation program generator is further configured to determine characteristics of a substrate loaded on the substrate support and determine the first and second subset of substrate support sections based on the determined substrate characteristics.

5. The printing system of claim 3, wherein the vacuum activation program generator is further configured to determine the first subset of the substrate support sections to be those substantially central to a substrate loaded on the substrate support.

6. The printing system of claim 5, wherein the vacuum activation program generator is further configured to determine the second subset of substrate support sections to be those sections immediately adjacent to the first subset of substrate support sections.

7. The printing system of claim 1, wherein the controller is configured, subsequent to vacuum pressure from the vacuum source being applied to different ones of the substrate support sections in accordance with the vacuum activation program, to control the printing system to perform a printing operation on the secured substrate.

8. The printing system of claim 7, wherein the controller is configured, subsequent to completion of the printing operation to release vacuum pressure from each of the substrate support sections.

9. A method, in a printing system, of securing a substrate to a substrate support, the substrate support comprising a plurality of substrate support sections, comprising:

obtaining a vacuum activation program defining a plurality of subsets of substrate support sections, a sequence in which vacuum pressure is to be applied to the subsets of substrate support sections, and timing data that defines a time delay for application of vacuum essure;

selectively controlling a vacuum control element associated with each substrate support section in accordance with the vacuum activation program to apply, subsequent to a substrate being loaded on the substrate support, vacuum pressure from a vacuum source to a first subset of the substrate support sections; and, after the time delay defined by the timing data, to apply vacuum pressure from the vacuum source to a second subset of the substrate support sections.

10. The method of claim 9, further comprising determining the first subset of substrate support sections to apply vacuum pressure to by:

determining characteristics of the substrate; and determining the subset of substrate support sections that are substantially central to the substrate loaded on the substrate support.

11. The method of claim 9, further comprising determining a second subset of substrate support sections to apply vacuum pressure to by:

determining the subset of substrate support sections that are immediately adjacent the first subset of substrate support sections.

12. The method of claim 9, further comprising, printing an image on a substrate secured to the substrate support.

13. An apparatus, comprising:

a substrate table having a plurality of substrate support sections each having an array of orifices selectably in fluid communication with a vacuum source;

a vacuum activation program generator that, in accordance with a vacuum activation program, is configured to identify which of the substrate support sections are at least partially covered by a substrate when loaded on the substrate support table, determine a first subset of the substrate support sections to which vacuum pressure is to be applied, and determine a second subset of the substrate support sections to which vacuum pressure is to be subsequently applied.

14. The apparatus of claim 13 wherein the vacuum activation program defines:

a plurality of the substrate support sections to which vacuum pressure is to be applied;

a sequence in which vacuum pressure is caused to be applied to the plurality of substrate support sections by the vacuum action program generator; and timing data that defines a time delay between activation of vacuum pressure to different ones of the substrate support sections.

* * * * *